US008029379B1

(12) United States Patent
Johansen

(10) Patent No.: US 8,029,379 B1
(45) **Date of Patent: *Oct. 4, 2011**

(54) GOLF PUTTING TRAINING APPARATUS AND METHOD OF TRAINING A GOLFER TO USE A PUTTER

(76) Inventor: Chad Johansen, Warrenville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/798,604

(22) Filed: Apr. 7, 2010

(51) Int. Cl.
*A63B 69/36* (2006.01)

(52) U.S. Cl. ..... 473/257; 473/261

(58) Field of Classification Search ..... 473/257, 473/258, 260–269; D21/791
See application file for complete search history.

(56) References Cited

U.S. PATENT DOCUMENTS 5,131,659 A * 7/1992 Lindberg, Jr. ..... 473/267
D332,817 S * 1/1993 Mullen ..... D21/791
5,209,484 A * 5/1993 Randall ..... 473/265
5,294,124 A * 3/1994 Florian ..... 473/267
5,332,211 A * 7/1994 Rife et al. ..... 473/258
5,351,962 A 10/1994 Lin
6,129,639 A * 10/2000 Brock et al. ..... 473/260
6,773,357 B2 * 8/2004 Tai et al. ..... 473/195
2002/0169029 A1 11/2002 Bradbury
2006/0258477 A1 11/2006 Sheridan

OTHER PUBLICATIONS

International Searching Authority/USPTO; International Search Report regarding PCT/US2011/00608; Jun. 9, 2011; 2 pages.
International Searching Authority/USPTO; Written Opinion of the International Searching Authority regarding PCT/US2011/00608; Jun. 9, 2011; 9 pages.

* cited by examiner

*Primary Examiner* — Nini Legesse
(74) *Attorney, Agent, or Firm* — Law Office of John W. Harbst

(57) ABSTRACT

A golf putting training apparatus for improving a golf stroke along a line of intended travel of a golf ball. The golf training apparatus includes a pair of upright supports and an eye alignment tool for aligning a user's eyes above the apparatus and in a vertical plane that includes the golf ball and the line of intended travel. The eye alignment tool is supported by and connected between the supports and above the golf ball and includes a substantially linear top edge and pair of generally parallel planar sides depending from the top edge toward a bottom edge. A method of training a golfer to use a putter used by the golfer during a golf putting stroke is also disclosed.

20 Claims, 6 Drawing Sheets

GOLF PUTTING TRAINING APPARATUS AND METHOD OF TRAINING A GOLFER TO USE A PUTTER

FIELD OF THE INVENTION DISCLOSURE

This invention disclosure generally relates to the game of golf and, more particularly, to a golf putting training apparatus and method of training a golfer to use a putter.

BACKGROUND OF THE INVENTION DISCLOSURE

Golf is a popular game but one that is technically demanding. Learning correct techniques to be used on a golf course can lead to significant improvements in a golfer's performance and, thus, lead to lower scores. To become a better golfer, a golfer must master consistency in all aspects of their various swings.

The putting stroke is only one of several types of golf swings, yet it accounts for nearly half of all swings made during regulation play. Despite its rather innocent-looking appearance, and as any good golfer knows, the ability to accurately and consistently putt a golf ball is a very difficult skill to develop, acquire and maintain.

During putting, a golfer typically imagines a target line between the position of the ball on the green or putting surface and the golf cup or "hole." The target line imagined by the golfer is that path for the ball which, if followed, results in the ball landing in the cup. To properly envision the target line, it is helpful for a golfer to vertically align their line of sight with a vertical plane which is perpendicular to the putting green or surface and passes through the centerline of the ball. If the golfer's line of sight is not aligned in this manner, it is less likely the golfer will correctly envision the target line, and more likely the golfer will envision a line that does not lead the ball to the cup thereby adding frustration to the game and the golfer. Even if the remainder of the golfer's putting stroke is perfect, the ball is likely to follow the improperly envisioned line, rather than the target line and not land in the cup.

Even if the golfer does properly envisions the target line, the ball can still miss the cup if the club face or striking surface of the putter does not travel along a target line during the golfer's putting stroke. Additionally, and even if the golfer does properly envision the target line and swings the club face of the putter in line with the target line during the putting stoke, the ball can nevertheless still miss the cup if the striking surface or club face of the putter is not square to the ball when the club face contacts the ball. In order to develop an accurate and consistent putting stroke, the golfer will find it helpful to combine each of the elements of properly aligning the golfer's line of sight over the target line, swing the putter club face in line with the target line, and squaring the club face of the putter when the club face contacts the ball.

In view of the foregoing, there is continuing need and desire for a golf putting training apparatus in which a correct putting swing can be taught along with a method for training a user to swing a golf putter.

SUMMARY OF THE INVENTION DISCLOSURE

According to one aspect of this invention disclosure there is provided a golf putting training apparatus. The golf training apparatus includes a first upright support, a second upright support, and an eye alignment tool for locating a user's eyes above the apparatus. The eye alignment tool includes a single elongated guide member supported by and connected between the supports and laterally centered above the golf ball. The guide member includes a substantially linear top edge and pair of generally parallel planar sides depending from the top edge toward a lower bottom edge.

The planar surfaces on the guide member provide a visual indication regarding whether the user's eyes are located in a vertical plane extending through the eye alignment apparatus and the centerline of the golf ball. In one form, at least one of the supports defines a target which is centered with respect to the intended travel of the golf ball. In one embodiment, such a target is at least as large as a regulation size golf ball. In another form, each support defines a target which is centered with respect to the intended travel of the golf ball. In this embodiment, the targets defined by the supports are each at least as large as a regulation size golf ball. Preferably, the golf putting training apparatus further includes a reflective device adapted to be positioned under the eye alignment tool for indicating where the user's head is located relative to the vertical plane along with inadvertent movement of the user's head during a putting stroke.

According to another aspect, there is provided a golf training apparatus including a first upright support, a second upright support, and an elongated rigid eye alignment tool for locating a user's eyes above the apparatus and in a vertical plane extending generally perpendicular to a putting surface. The eye alignment tool includes a single elongated guide member supported by and connected between the supports and laterally centered above a golf ball on the putting surface. The guide member includes a substantially linear top edge and pair of generally parallel sides depending from said top edge toward a lower a bottom edge.

In a preferred embodiment, the planar surfaces on the provides a visual indication regarding the location of the user's eyes relative to the vertical plane passing through the eye alignment apparatus and centerline of the golf ball. In one form, at least one of the supports defines a target opening which is centered with respect to the intended travel of the golf ball. In this form, the target opening defined by at least one of the supports is at least as large as a regulation size golf ball. In another form, each support defines a target opening which is centered with respect to the intended travel of the golf ball. In this form, the target openings are at least as large as a regulation size golf ball.

Preferably, the golf putting training apparatus further includes a reflective device adapted to be positioned under the eye alignment tool for indicating to the user where the user's head is located relative to the vertical plane. The reflective device is preferably provided with an indicator for aligning the reflective device with the elongated rigid eye alignment tool during use of the golf putting training apparatus.

According to another aspect, there is provided a method of training a golfer to use a putter having a putting head with a reference marker extending across a striking face thereof and which is to be used by the golfer to strike a golf ball during a golf putting stroke. Such method includes the steps of: arranging a golf training apparatus in operable combination with a golf ball on a putting surface, with the golf training apparatus including a pair of upright supports and an eye alignment tool. The tool includes a single elongated guide member supported by and connected between the supports and laterally centered above the golf ball. The guide member includes a substantially linear top edge defining a single line of intended travel for the ball and pair of generally parallel planar sides depending from the top edge toward a lower bottom edge of the guide member. Another step in the method involves: using the planar sides of the single guide member to locate the golfer's eyes above the apparatus and in a vertical plane that includes the golf ball and the single line of intended travel for the ball such that the top edge and a predetermined extent of the planar sides of the eye alignment tool are viewable to the golfer.

The method of training a golfer can include the further step of: aligning the reference marker on the striking face of the putter head with the vertical plane including the golf ball and the line of intended travel of the ball. Preferably, the method of training a golfer includes the further step of: providing a mirrored surface sufficiently sized to reflect the golfer's face beneath the ball and the eye alignment tool of the golf training apparatus such that the golfer can view head movements and eye aligning during a putting stroke.

The method of training a golfer can include the further step of: proving a target on at least one of the supports. Alternatively, the method of training a golfer can include the further step of: providing a target opening on each of the supports, with each opening being defined at least as large as a regulation size golf ball.

DETAILED DESCRIPTION

Figure 1:
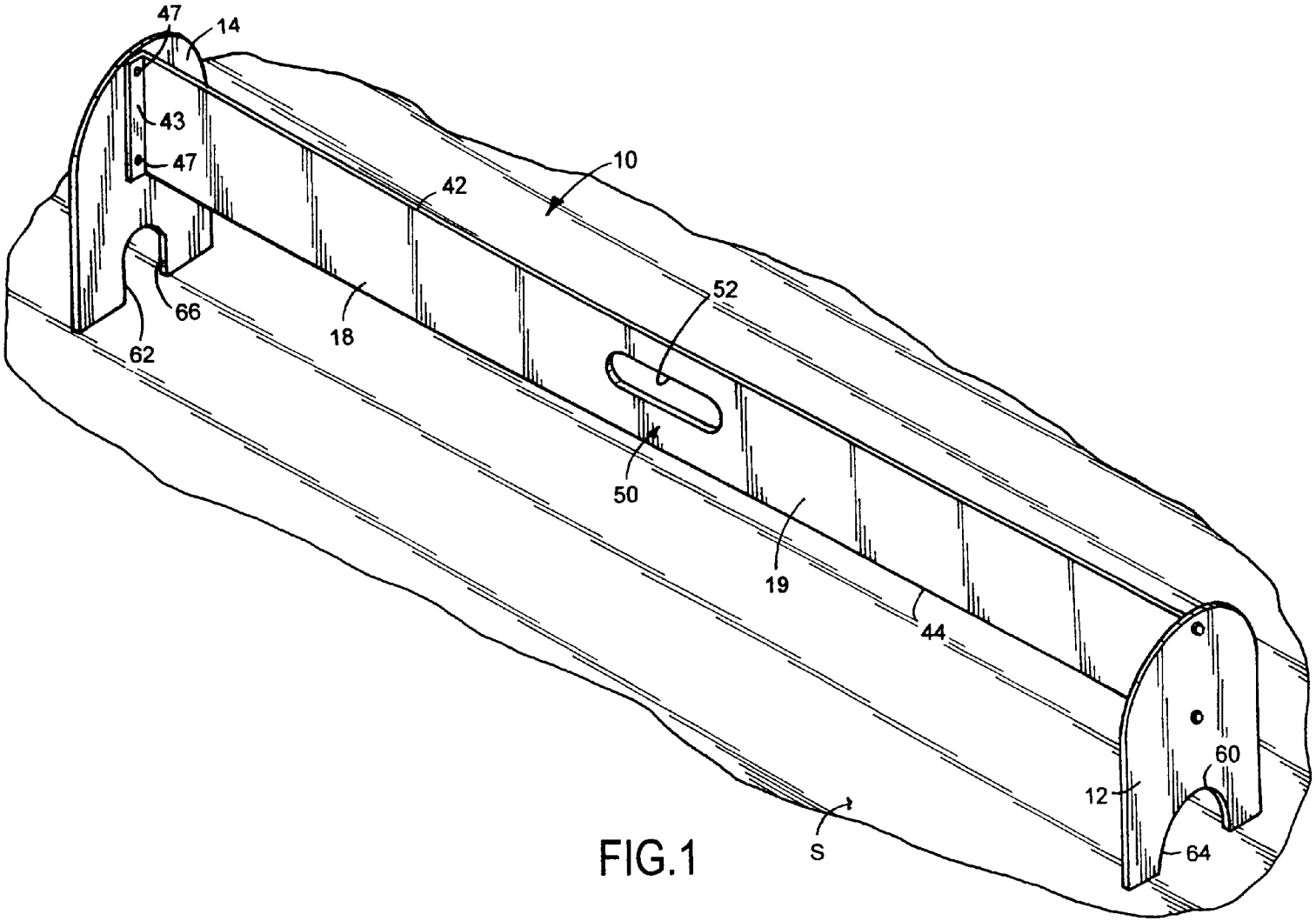
FIG. 1 is a perspective view of one form of a golf training putting apparatus embodying principals of this invention disclosure.

While this invention disclosure is susceptible of embodiment in multiple forms, there is shown in the drawings and will hereinafter be described a preferred embodiment, with the understanding the present disclosure sets forth an exemplification of the disclosure which is not intended to limit the disclosure to the specific embodiment illustrated and described.

Referring now to the drawings, wherein like reference numerals indicate like parts throughout the several views, in FIG. 1 there is shown a golf putting training apparatus, generally indicated by reference numeral 10, which embodies principals of this invention disclosure and is arranged on a putting surface S. As shown in FIG. 1, the golf putting training apparatus 10 includes a first upright and rigid support 12, a second upright and rigid support 14, along with a rigid and longitudinally elongated eye alignment tool 18.

Support 12 is preferably fabricated from a suitable metal material such as aluminum or the like. In the embodiment illustrated in FIGS. 1 and 2, support 12 extends upwardly or vertically in a direction preferably perpendicular to the putting surface S. Similarly, support 14 is preferably fabricated from a suitable metal material such as aluminum or the like. In the embodiment illustrated in FIGS. 1 and 2, support 14 extends upwardly or vertically in a direction preferably perpendicular to the putting surface S.

The eye alignment tool 18 has an elongated configuration and is likewise preferably formed from a suitable metal material such as aluminum or the like. In the embodiment illustrated in FIGS. 3 and 4, the eye alignment tool 18 includes a single elongated guide member 19 having a substantially linear upper or top edge 42, a lower or bottom edge 44, and a pair of generally parallel planar side surfaces 46 and 48 (FIG. 2) extending between edges 42 and 44. In one form, guide member 19 has a generally rectangular configuration between the edges thereof. In a preferred embodiment, guide member 19 has a length (the distance between opposed ends) ranging between about 42 inches to about 47 inches and a height (the vertical distance between the top and bottom edges 42 and 46) of about 3.5 inches and about 4.5 inches. In a most preferred form, guide member 19 has a length of about 45.2 inches and a height of about 4.0 inches. Moreover, guide member 19 has a thickness (the distance between the planar surfaces 46 and 48) ranging between about 0.097 inches and about 0.187 inches. In a preferred form, guide member 19 has a thickness of about 0.125 inches.

Figure 2:
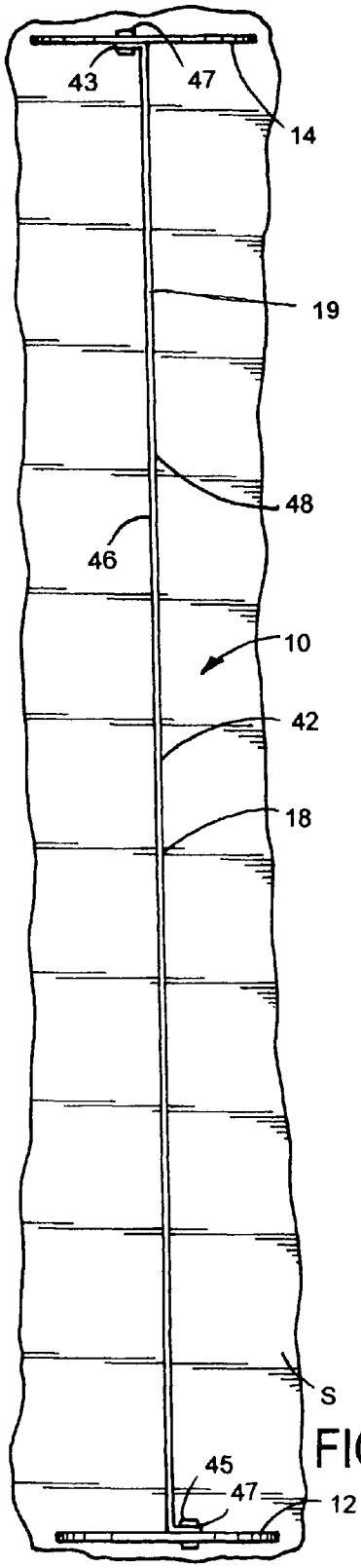
FIG. 2 is a top plan view of the golf training putting apparatus illustrated in FIG. 1.
Figure 3:
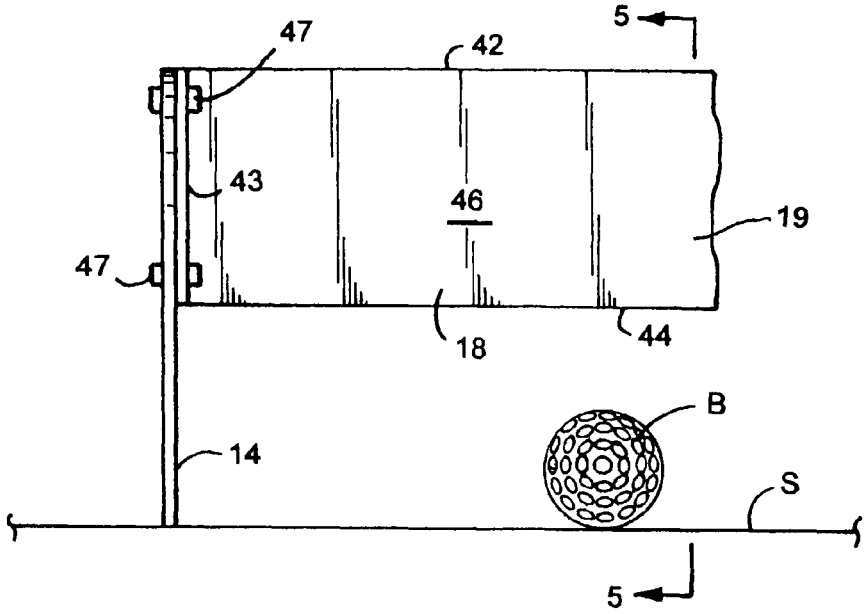
FIG. 3 is an enlarged fragmentary elevational view of one end of the golf training putting apparatus illustrated in FIG. 1.

As illustrated by way of example in FIGS. 2 and 3, one end of the guide member 19 is provided with a mounting flange 43 to facilitate releasable attachment of that end of the tool toward an upper end of the support 12. Any suitable form of fasteners 47 including a threaded bolt and nut combination can be used to operably connect the end of guide member 19 to support 12.

Figure 4:
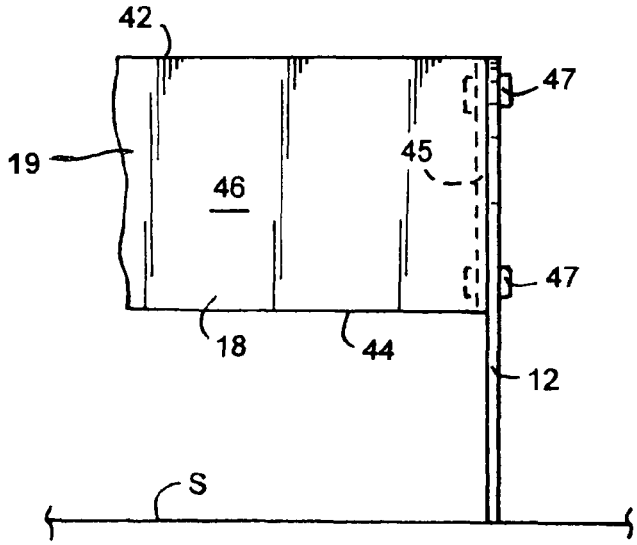
FIG. 4 is an enlarged fragmentary elevational view of an opposite end of the golf training putting apparatus illustrated in FIG. 1.

As illustrated by way of example in FIGS. 2 and 4, an opposite end of the guide member 19 is provided with a mounting flange 45 to facilitate releasable attachment of the end of the tool 18 toward an upper end of the support 14. Again, any suitable form of fasteners 47 including a threaded bolt and nut combination or other forms of releasable fasteners can be used to operably connect the end of guide member 19 to support 14. The releasable attachment of guide member 19 to supports 12, 14 facilitates handling, shipping and overall transportation of apparatus 10. It is also within the spirit and scope of this invention disclosure to allow the eye alignment guide member 19 to be operably connected to the supports 12 and 14 so as to allow for adjustment of the vertical spacing under and between the lower or bottom edge 44 of guide member 19 and the putting surface S (FIG. 3). In one form, such adjustments can be affected through the provision of elongated vertical slots in either the attachment flange portions of guide member 19 of through elongated slots in the supports 12, 14.

Figure 5:
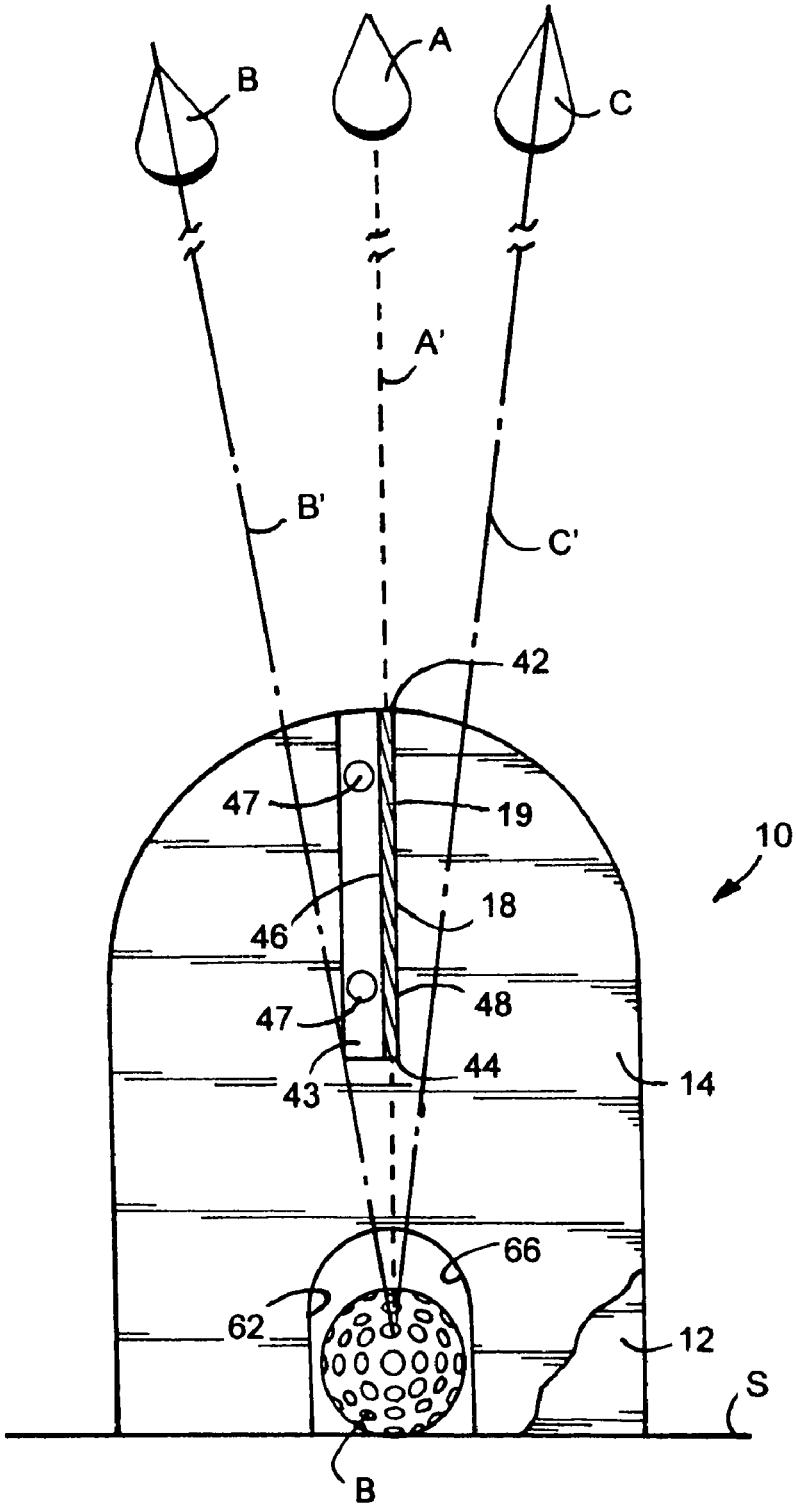
FIG. 5 is an enlarged sectional view taken along line 5-5 of FIG. 3 and illustrates how the golf training putting apparatus enables the golfer to judge whether their eyes are in alignment in a vertical plane over a golf ball.
Figure 13:
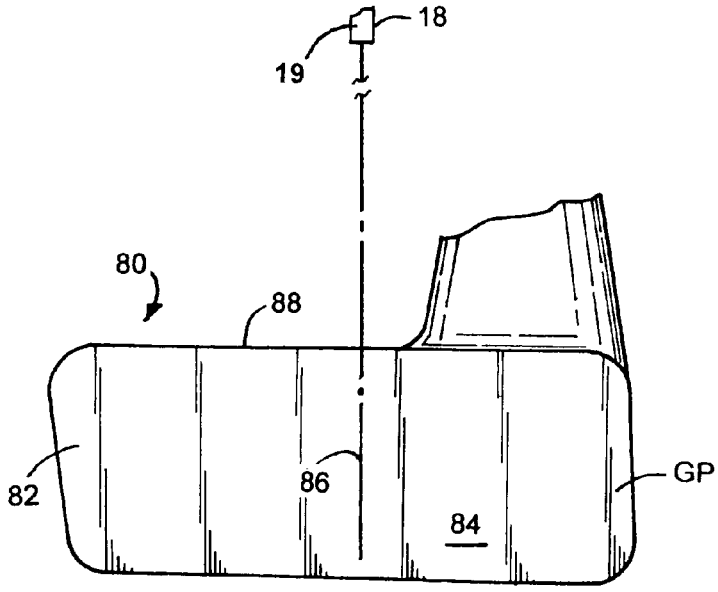
FIG. 13 is a fragmentary showing of a conventional golf putter.

As shown in FIGS. 3 and 4, when guide member 19 is operably joined to supports 12, 14, the lower or bottom edge 44 of guide member 19 is vertically spaced from the putting surface S a sufficient distance to permit a regulation size golf ball B (FIG. 3) to be placed thereunder and with sufficient room such that a head of a conventional golf putter 80 (FIG. 13) can fit thereunder in a manner permitting a golfer to practice their putting swing movements. As shown in FIG. 5, and when guide member 19 is operably joined to supports 12, 14, the sides 46 and 48 of the eye alignment guide member 19 are disposed in a vertical plane extending generally perpendicular to the putting surface S. Notably, and during use of apparatus 10, the upper or top edge 42 of the eye alignment guide member 19 defines a single target line TL (FIGS. 6, 7 and 8) which is a preferred path for a golf ball to follow as it passes toward a target.

In one embodiment of apparatus 10, the upper or top edge 42 of the eye alignment guide member 19 is highlighted by treating or otherwise being provided with coloring, i.e., white paint or other suitable indicator for enhancing a golfer's perception of the line of travel to be taken by a golf ball during use of apparatus 10. Moreover, the planar sides 46 and 48 of the eye alignment guide member 19 are also preferably highlighted by treating or otherwise being provided with coloring, i.e. a brightly colored paint other than or different from that used on the top edge 42 or other suitable indicator. Of course, the opposed sides 46 and 48 could each have an individual color or indicator thereon different from the top edge 42 and different from each other without detracting or departing from the spirit and scope of this disclosure.

Returning to FIG. 1, apparatus 10 furthermore preferably includes a handle 50 for facilitating transportation of apparatus 10 between locations. In a preferred form, and to limit detractions to the golfer using apparatus 10, the handle 50 preferably includes an elongated slot or opening 52 in guide member 19 approximately midlength between opposed ends thereof. Preferably, the opening 52 in guide member 19 has a closed margin and extends laterally through the guide member 19 such that no projections extend outwardly from opposed sides 46, 48 of the guide member 19 which could prove to be detractions for the user of apparatus 10.

Figure 9:
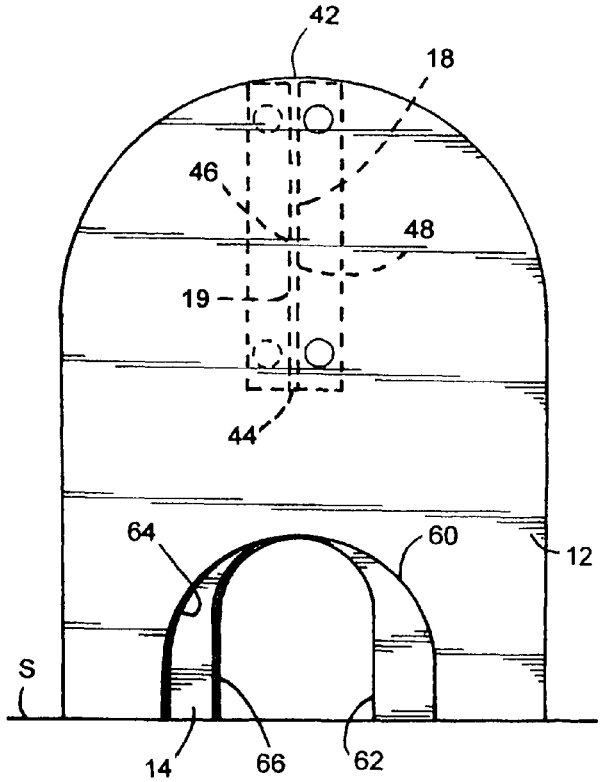
FIG. 9 is an enlarged end view of the golf training putting apparatus illustrated in FIG. 1.

In the exemplary form illustrated in FIG. 9, at least one of the supports 12, 14 of apparatus 10 defines a target 60. In a preferred form, each of the supports 12, 14 defines a target 60, 62, respectively. Each target 60, 62 is centered with respect to the intended travel of the golf ball B or target line TL during practice. Each target 60, 62 defined by the supports 12, 14, respectively, is at least as large as regulation size golf ball. In a preferred form, each target 60, 62 is defined by an opening 64, 66, respectively, in the respective support 12, 14.

Figure 10:
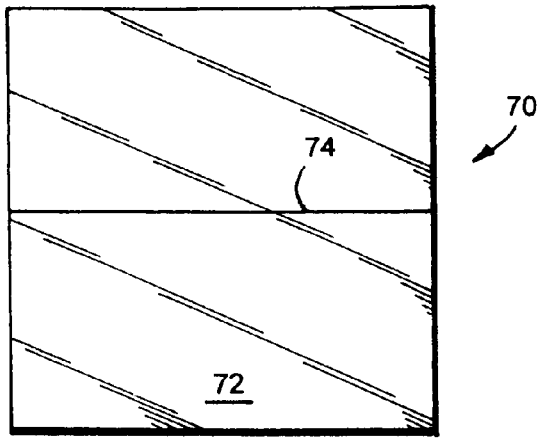
FIG. 10 is a plan view of a reflective device which can be used in operable combination with the golf putting training apparatus of this invention disclosure.
Figure 12:
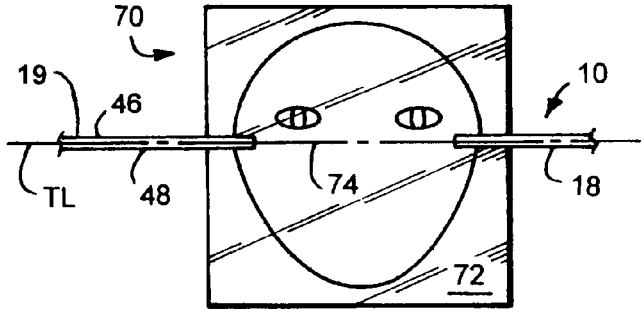
FIG. 12 is a fragmentary schematic representation of the image provided by the reflective device when used in operable combination with the golf putting training apparatus of this invention disclosure.
Figure 11:
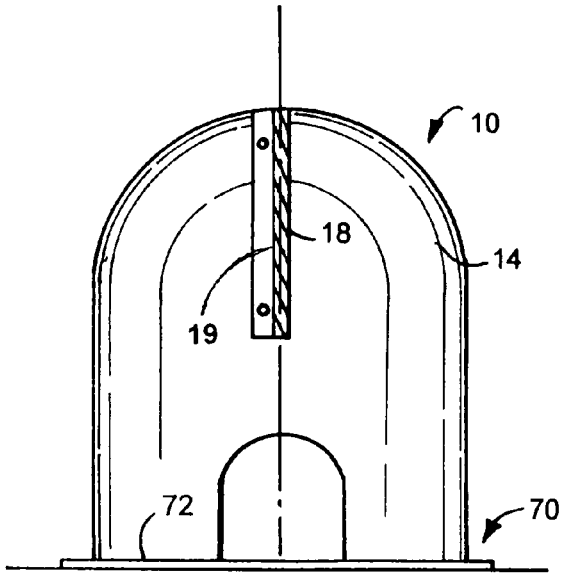
FIG. 11 is an end view illustrating the reflective device shown in FIG. 10 in operable combination with the golf putting training apparatus of this invention disclosure.

According to another aspect of the present disclosure, and as shown in FIGS. 10, 11 and 12, there is provided a reflective device 70 adapted for use in combination with the golf putting training apparatus 10. In the illustrated embodiment, the reflective device 70 has a reflective surface 72 and, as schematically represented in FIG. 12, is sized to reflect the face of the golfer using the golf putting training apparatus 10. As illustrated in FIG. 10, the reflective device 70 is provided with a line or indicator 74 preferably extending thereacross.

When arranged in operable combination with the golf putting training apparatus 10, and as shown in FIGS. 11 and 12, the reflective device 70 is positioned or placed under the eye alignment tool 18 with the reflective surface 72 facing toward the tool 18 and with the line or indicator 74 on surface 72 (FIG. 12) being aligned with the target line TL defined by the eye alignment tool 18. The purpose of device 70 is to provide the user of apparatus 10 with an immediate visual indication of any unwanted and inadvertent head movements along with eye alignment relative to the vertical plane defined by the eye alignment apparatus 18 and the centerline of the golf ball during a putting stroke.

In use, and as shown in FIG. 5, the eye alignment tool 18 of apparatus 10 enables a user to judge when their eyes are in alignment in a vertical plane over the golf ball B. FIG. 5 schematically illustrates the user's eyes in three different positions A, B and C along with the corresponding line of sight A', B' and C'.

Figure 6:
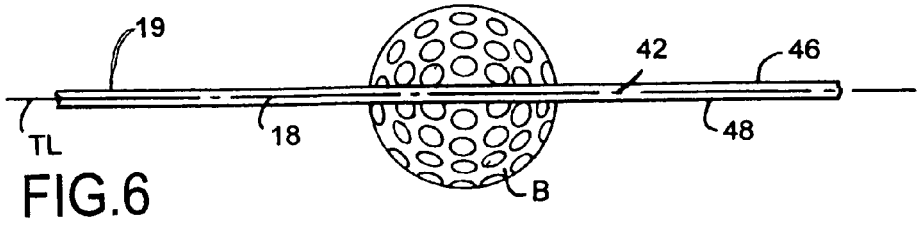
FIG. 6 is a fragmentary and enlarged schematic illustration of what the golfer views when using the golf training putting apparatus of the present disclosure and their eyes are in alignment in a vertical plane over a golf ball.

As will be appreciated from sight line A', and as represented in FIG. 6, when the user's eyes are properly positioned or aligned directly over and in alignment with a vertical plane passing through the guide member 19 and the centerline of golf ball B (as represented in position "A"), the user only sees the top edge 42 of the guide member 19. That is, the user's eyes cannot see either planar side 46 or 48 of the guide member 19. Accordingly, the guide member 19 of the eye alignment tool 18 provides a clear indication the user is properly aligned with the ball B to affect a proper putting stroke. As will be appreciated from FIG. 6, providing a highlighting indicator, such as paint or the like, along the top edge 42 of the guide member 19 will only serve to enhance a golfer's perception of the single line of travel TL to be taken by a golf ball during use of apparatus 10.

Figure 7:
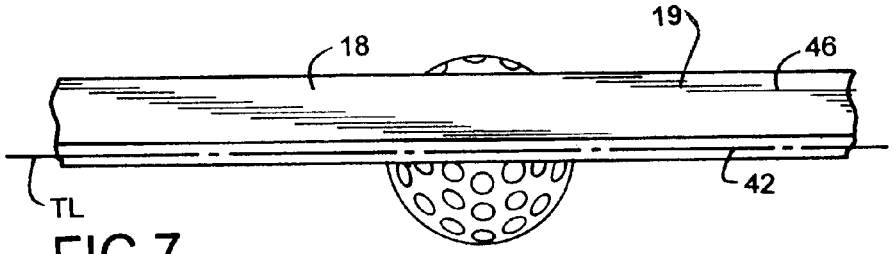
FIG. 7 is a fragmentary and enlarged schematic illustration of what the golfer views when using the golf training putting apparatus of the present disclosure and their eyes are not in alignment in a vertical plane over a golf ball.

When the user's eyes are not in the vertical plane (as represented in position "B") and the user views the eye alignment tool along sight line B', and as represented in FIG. 7, the user will see both the top edge 42 and the planar side 46 of the guide member 19. As such, the guide member 19 of the eye alignment tool 18 will provide the user with a visual image and clear indication they are not properly aligned with the ball B to affect a proper putting stroke and the user should relocate to affect proper alignment. As will be appreciated from FIG. 7, providing a high lighting indicator, such as a bright paint color or the like, on surface 46 of guide member 19 which is different from the highlighting indicator on the top edge 42 of the guide member 19 will only serve to enhance a user's perception of their vertical misalignment relative to the ball B to affect a proper putt.

Figure 8:
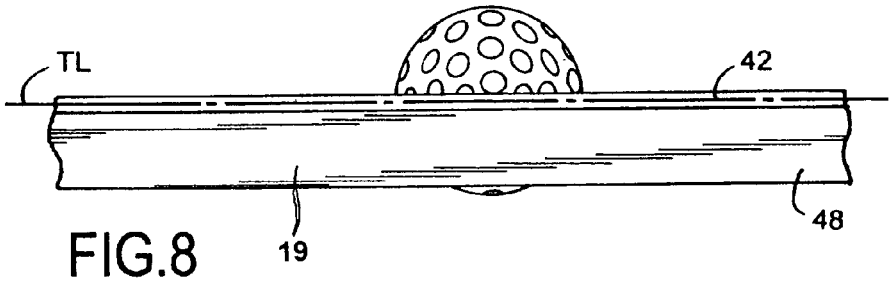
FIG. 8 is a fragmentary and enlarged schematic illustration similar to FIG. 7 showing what the golfer views when using the golf training putting apparatus of the present disclosure and their eyes are not in alignment in a vertical plane over a golf ball.

When the user's eyes are not in the vertical plane (as represented in position "C") and the user views the eye alignment tool along sight line C', and as represented in FIG. 8, the user will see both the top edge 42 and the planar side 48 of the guide member 19. As such, the guide member 19 of the eye alignment tool 18 will provide the user with a visual image and clear indication they are not properly aligned with the ball B to affect a proper putting stroke and the user should relocate to affect proper alignment. As will be appreciated from FIG. 8, providing a high lighting indicator, such as a bright paint color or the like, on surface 48 of guide member 19 which is different from the high lighting indicator on the top edge 42 of the eye alignment guide member 19 will only serve to enhance a user's perception of their vertical misalignment relative to the ball B to affect a proper putt. Moreover, providing a high lighting indicator, such as a bright paint color or the like, on planar surface 48 of guide member 19 which is different from either the high lighting indicator on the top edge 42 or the high lighting color on the opposed planar surface 46 of the eye alignment guide member 19 will only serve to enhance a user's perception of their vertical misalignment relative to the ball B to affect a proper putt along with providing an indicator of the direction of their misalignment.

A fragmentary showing of a conventional golf putter is represented generally by reference numeral 80 in FIG. 9. A typical putter 80 includes a putter head 82 defining a generally planar surface or striking face 84. Putter alignment mark(s), generally represented by reference numeral 86, are usually provided on the striking face 84 of the putter 80. Such visual alignment marks or aids 86 can be incorporated into the putter designs and are typically a vertical groove on the face 82 or the top putter surface 88 of the putter head 82. Such grooves can be highlighted by the use of white, black, red or other contrasting colors of paint or colored inserts.

According to another aspect of the present invention disclosure, the eye alignment tool 18 of apparatus 10 furthermore facilitates proper positioning of the club face or striking surface 84 of the putter 80 along the single target line TL (FIG. 6) during the golfer's putting stroke. That is, by maintaining the visual alignment marks or aids 86 on the putter 80 in line with the top edge 42 of the guide member 19, proper positioning of the club face or striking surface 82 of the putter 80 along the single target line TL (FIG. 6) during the golfer's putting stroke is enhanced.

According to still another aspect, there is provided a method of training a golfer to use a putter 80 having a putting head 82 with a reference marker 86 extending across a striking face 84 thereof and which is to be used by the golfer during a golf putting stroke. Such method includes the steps of: arranging a golf training apparatus 10 in operable combination with a golf ball B on a putting surface S, with the golf training apparatus 10 including a pair of upright supports 12, 14 and an eye alignment tool 18 extending along a single line of intended travel for the golf ball, with the tool 18 being supported by and connected between the supports 12, 14 and laterally centered above the golf ball B. The eye alignment tool 18 includes a single guide member 19 having a substantially linear top edge 42 defining single line of intended travel for the golf ball and pair of generally parallel planar sides 46, 48 depending from the top edge 42 toward a lower bottom edge 46. Another step in the process involves using the planar sides 46, 48 of the guide member 19 to locate the golfer's eyes above the apparatus 10 and in a vertical plane that includes the golf ball and the single line of intended travel such that the top edge 42 and a predetermined extent of the planar sides 46, 48 of the guide member 19 are viewable to the golfer.

The method of training a golfer can include the further step of: aligning the reference marker 86 on the striking face 84 of the putter head 82 with the vertical plane including the golf ball B and the line of intended travel of the ball. Preferably, the method of training a golfer includes the further step of: providing a mirrored or reflective surface 72 sufficiently sized to reflect the golfer's face beneath the ball B and the eye alignment tool 18 of the golf training apparatus 10 such that the golfer can view head movements and eye alignment during a putting stroke.

The method of training a golfer can include the further step of: proving a target 60 on at least one of the supports 12, 14. Alternatively, the method of training a golfer can include the further step of: providing a target opening 64, 66 on the supports 60, 62, respectively, with each, opening 64, 66 being defined at least as large as a regulation size golf ball.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A golf putting training apparatus, comprising:

a first upright support;

a second upright support; and an eye alignment tool for locating a user's eyes above the apparatus, with said tool including a single elongated guide member supported by and connected between said supports and laterally centered above a golf ball arranged on a putting surface, with said guide member having a substantially linear top edge defining a single line of intended travel for said ball and a pair of generally parallel planar sides depending from said top edge toward a lower bottom edge, with the planar sides of said single guide member providing a visual indication whether the user's eyes are located in a vertical plane extending perpendicular to said putting surface and including the golf ball and the single line of intended travel for said ball.

2. The golf putting training apparatus according to claim 1 wherein said guide member is laterally centered relative to said first and second supports.

3. The golf putting training apparatus according to claim 1 wherein at least one of said supports defines a target which is centered with respect to the intended travel of the golf ball.

4. The golf putting training apparatus according to claim 3 wherein the target defined by at least one of said supports is at least as large as a regulation size golf ball.

5. The golf putting training apparatus according to claim 1 wherein each of said supports defines a target which is centered with respect to the intended travel of the golf ball.

6. The golf putting training apparatus according to claim 5 wherein the target defined by said supports is at least as large as a regulation size golf ball.

7. The golf putting training apparatus according to claim 1 further including a reflective device adapted to be positioned under said eye alignment tool for indicating whether where the user's head is located relative to said vertical plane.

8. A golf training apparatus, comprising:

a first upright support;

a second upright support; and an elongated rigid eye alignment tool for locating a user's eyes above the apparatus and in a vertical plane extending generally perpendicular to a putting surface, and wherein said tool includes a single elongated guide member supported by and connected between said supports and above a golf ball on said putting surface in laterally centered relation relative to said guide member, with said guide member having a substantially linear top edge defining a single line of intended travel for said ball and a pair of generally parallel sides extending perpendicular to the putting surface and depending from said top edge toward a lower a bottom edge of said guide member, with a majority of a surface defined by each planar side of said guide member being different than surface on the top edge of said guide member so as to provide a visual indication whether the user's eyes are located in the vertical plane extending perpendicular to the putting surface and including the golf ball and the single line of intended travel for said ball.

9. The golf putting training apparatus according to claim 8 wherein said guide member is laterally centered relative to said first and second supports.

10. The golf putting training apparatus according to claim 8 wherein at least one of said supports defines a target opening which is centered with respect to the intended travel of the golf ball.

11. The golf putting training apparatus according to claim 10 wherein the target opening defined by at least one of said supports is at least as large as a regulation size golf ball.

12. The golf putting training apparatus according to claim 8 wherein each of said supports defines a target opening which is centered with respect to the intended travel of the golf ball.

13. The golf putting training apparatus according to claim 12 wherein the target opening defined by said supports is at least as large as a regulation size golf ball.

14. The golf putting training apparatus according to claim 8 further including a reflective device adapted to be positioned under said eye alignment tool for indicating to the user where the user's head is located relative to said vertical plane.

15. The golf putting training apparatus according to claim 14 wherein said reflective device is provided with an indicator for aligning said reflective device with said elongated rigid eye alignment tool during use of said golf putting training apparatus.

16. A method of training a golfer to use a putter having a putting head with a reference marker extending across a striking face thereof and which is to be used by the golfer to strike a golf ball during a golf putting stroke, said method comprising the steps of:

arranging a golf training apparatus in operable combination with a golf ball on a putting surface, with said golf training apparatus including a pair of upright supports and an eye alignment tool, with said tool including a single elongated guide member supported by and connected between said supports and laterally centered above the golf ball, with said guide member having a substantially linear top edge defining a single line of intended travel for said golf ball and a pair of generally parallel planar sides extending perpendicular to the putting surface and depending from said top edge toward a lower bottom edge of said guide member;

using the planar sides of said single guide member to locate the golfer's eyes above the apparatus and in a vertical plane that includes the golf ball and the single line of intended travel for said ball such that the top edge and a predetermined extent of the planar sides of the eye alignment tool are viewable to the golfer.

17. The method of training a golfer according to claim 16 including the further step of:

aligning the reference marker on the striking face of the putter head with the vertical plane including the golf ball and the line of intended travel of said ball.

18. The method of training a golfer according to claim 16 including the further step of:

providing a mirrored surface sufficiently sized to reflect the golfer's face beneath the ball and the eye alignment tool of the golf training apparatus such that the golfer can view head movements and eye aligning during a putting stroke.

19. The method of training a golfer according to claim 16 including the further step of:

proving a target on at least one of said supports.

20. The method of training a golfer according to claim 16 including the further step of:

providing a target opening on each support, with each opening being defined at least as large as a regulation size golf ball.

* * * * *